US005442872A

United States Patent [19]

Moser

[11] Patent Number: 5,442,872

[45] Date of Patent: Aug. 22, 1995

[54] DEVICE FOR HOLDING STRIP-LIKE INFORMATION CARRIERS

[75] Inventor: Richard Moser, Stockholm, Sweden

[73] Assignee: HL Display AB, Tyreso, Sweden

[21] Appl. No.: 211,012

[22] PCT Filed: Mar. 16, 1994

[86] PCT No.: PCT/SE92/00776

§ 371 Date: Mar. 16, 1994

§ 102(e) Date: Mar. 16, 1994

[87] PCT Pub. No.: WO/9310516

PCT Pub. Date: May 27, 1993

[30] Foreign Application Priority Data

Nov. 12, 1991 [SE] Sweden ..... 9103326

[51] Int. Cl.[6] ..... G09F 3/18

[52] U.S. Cl. ..... 40/642; 40/647

[58] Field of Search ..... 40/642, 661, 647, 5; 248/222.3

[56] References Cited

U.S. PATENT DOCUMENTS 4,394,909 7/1983 Valiulis et al. .
4,540,093 9/1985 Merl et al. .
4,583,308 4/1986 Taub ..... 40/642 X
4,801,116 1/1989 Blankenship ..... 40/661 X
4,821,437 4/1989 Abramson et al. ..... 40/642
5,235,766 8/1993 Fast et al. ..... 40/642 X
5,325,616 7/1994 Valiulis ..... 40/642 X

FOREIGN PATENT DOCUMENTS 2585549 2/1987 France ..... 40/642
223182 11/1942 Switzerland ..... 40/647

*Primary Examiner*—Kenneth J. Dorner
*Assistant Examiner*—Joanne Silbermann
*Attorney, Agent, or Firm*—Sughrue, Mion, Zinn, Macpeak and Seas

[57] ABSTRACT

A holder for strip-like information carriers for use in shops and stores in conjunction with goods and articles that are displayed on pronged racks. The holder includes a mounting part 1 intended to be fitted to the rack prong(s) and an information-carrier receiver 5 connected to the mounting part. The mounting part is secured to the inwardly located part of at least one prong, and has a cantilever arm 4 which extends above and generally parallel with the prong. The information-carrier receiver is fitted to the forward end of the arm in a manner which allows it to be swung up when removing an article from the prong.

8 Claims, 2 Drawing Sheets

A

DEVICE FOR HOLDING STRIP-LIKE INFORMATION CARRIERS

The present invention relates to a holder for strip-like information carriers intended for use in self-service stores, shops and like establishments for use in conjunction with goods displaced on a pronged rack and comprising a holder part which is intended to be fitted to the rack and an information-carrier receiving part which is connected to the first mentioned holder part.

Effective and efficient holders are known which can be fitted to the front edge surfaces of shelving, wire cages or baskets and the like in shops and stores, and which carry information strips relating to the goods displayed.

On the other hand, it has been more difficult to produce inexpensive and effective holder means for information carriers which disclose information concerning goods and articles that are displayed for sale on pronged racks, for instance packaged articles displayed on long, substantially horizontal prongs.

In order to enable customers to read the information disclosed, the information should be presented on labels of normal size placed on the forward ends of the prongs. It is also beneficial to store personnel when one and the same label size can be used in all instances. One problem, however, resides in the provision of a holder for labels of this kind which will not obstruct removal of packaged articles or other goods from the prongs. This is particularly difficult to achieve when the labels are placed forwardly of the ends of the prongs. Labels which are fitted above the prongs encroach on expensive display space. Furthermore, it is desirable to eliminate the need to use separate, empty prongs solely as label or tag carriers. The main object of the present invention is to provide a holder for strip-like information carriers which is intended for use with pronged racks and which eliminates the aforesaid drawbacks, among other things.

This object is achieved in accordance with the present invention in that the holder part, which is intended to receive an information carrier is mounted forwardly of the front ends of the prong and can be swung-up when removing articles from the prong or prongs of the rack structure.

According to the present invention, a holder of the kind defined in the first paragraph of the specification is mainly characterized in that the mounting part is intended to be fastened to the inwardly lying part of at least one prong and is provided with a cantilever arm which extends above and essentially parallel with the prong; in that the information-carrier receiving part of the holder has the form of a pocket which is open at its upper edge; in that the pocket is so mounted at the forward end of the cantilever arm as to enable said pocket to be swung-up when removing articles from the prong; and in that the forward end of the arm is provided with at least one support element which bears against the rear wall of the pocket, so that in a downwardly hanging position the pocket can be opened by exerting pressure on the lower part of the front wall of said pocket.

A holder of this kind has the advantage of enabling standard-sized labels to be used and placed in a position in which the information thereon can be read easily by the customer. Another advantage is that no additional space is required for the holder. Furthermore, the pocket can be opened very easily, which greatly facilitates the exchange of labels.

A preferred embodiment of an inventive holder is characterized in that the pocket is transparent; in that at least a portion of the upper part of the rear wall of the pocket is folded rearwardly to form a downwardly open cylindrical channel; and in that the forward end of the cantilever arm is provided with a transversal pivot-pin which coacts with said channel. The channel opening is somewhat narrower than the pivot-pin, so as to enable the pin to be pressed into the channel while flexing the channel wall outwards to some extent, so as to hold the pin in the channel when the channel wall returns to its original position.

It is preferred that the pocket can only be swung to a limited extent, so that the pocket will always return to its normal, downwardly swung position under the influence of gravity. To this end, there is conveniently formed in the channel wall a slot which receives the cantilever arm when the pocket is swung upwardly, the depth of the slot being adapted to limit the extent to which said part can be swung up. Preferably, the angle through which the pocket can be swung is limited to about 90°.

The invention will now be described in more detail with reference to an exemplifying embodiment thereof and also with reference to the accompanying drawings.

Figures 1, 2, 3, 4, 4A, 5, 6:
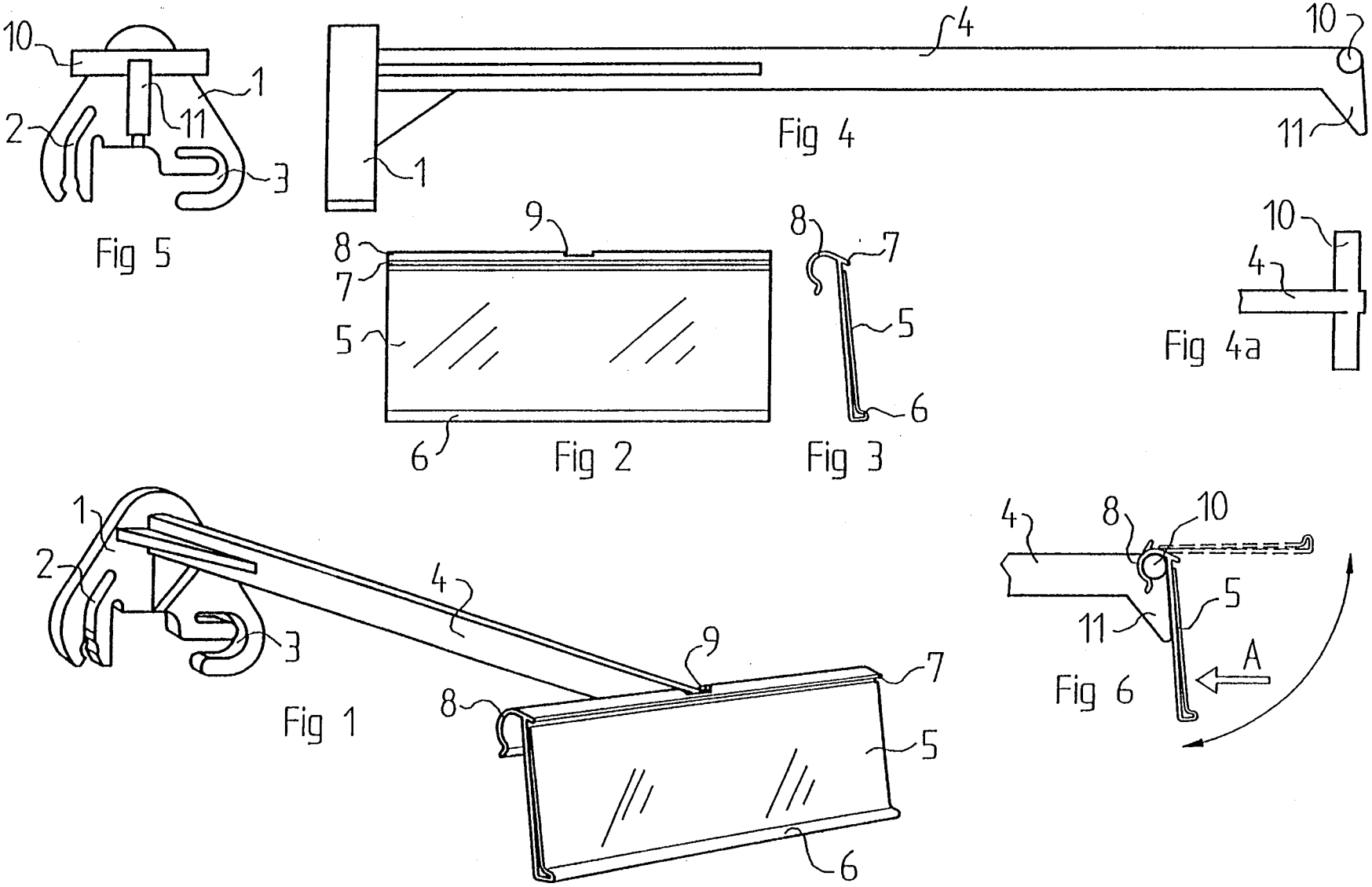
FIG. 1 is a perspective view of an inventive holder.
FIGS. 2 and 3 are respectively a front view and a side view of the part of the holder intended to receive an information carrier.
FIG. 4 is a side view of the holder and the cantilever arm.
FIG. 4A is a view from above of the forward end of the arm.
FIG. 5 is a front view of the arm shown in FIG. 4.
FIG. 6 illustrates the pocket-raising function of the inventive holder.

The holder shown in FIG. 1 includes a mounting part 1 which is intended to be fitted onto two mutually parallel prongs (not shown), said prongs being accommodated in a respective one of two slotted grooves 2 and 3. The grooves are configured so as to enable the mounting part to be fixed to prongs of varying diameters. As will be understood, however, the invention can be applied with other types of mounts, for instance mounts which are intended to be fitted solely to one prong or to a prong of non-round cross-section.

The illustrated holder also includes a cantilever arm 4 which extends out from the mounting part 1 and which has mounted on its forward end a part 5 which is intended to receive a strip-like information carrier.

As will be seen also from FIGS. 2 and 3, the holder part 5 has the form of a pocket which is made of flexible, transparent plastic material and which is open along the upper edge thereof. The bottom edge of the front wall of the pocket 5 is bent out to form a longitudinally extending ledge 6 along which an electronic reading device can be guided. The upper edge of the front wall of the pocket 5 is protected beneath a projection 7 that extends from the rear wall of the pocket.

Extending along the upper edge of the rear pocket wall is a folded arcuate part 8 which has an essentially cylindrical inner surface. The part 8 forms a downwardly open channel along the upper edge of said pocket. Punched in the part 8 is a slot 9 whose function will be described below.

As will be seen from FIGS. 4 and 4A, the front end of the arm 4 carries a transverse, cylindrical pivot-pin 10, which in the case of the illustrated embodiment is an integral part of the arm 4 and thus fixed in relation thereto. The arm is also provided with a downwardly projecting part 11 which functions to support the rear wall of the pocket 5. The supporting part 11 does not extend down to the bottom edge of the pocket 5, but terminates approximately in the centre of the pocket.

FIG. 5 is a front view of the arm 4, the pivot-pin 10 and the holder 1 shown in FIG. 4.

The pocket 5 is fitted to the pin 10 by pressing the pocket downwards so as to force that part of the pocket structure which forms the channel onto the pin 10 while flexing the channel wall outwards. When the channel wall returns to its normal position, the pocket is pivotally locked to the pin 10. If the pocket should become damaged, the pocket 5 can be readily replaced correspondingly.

Figure 7:
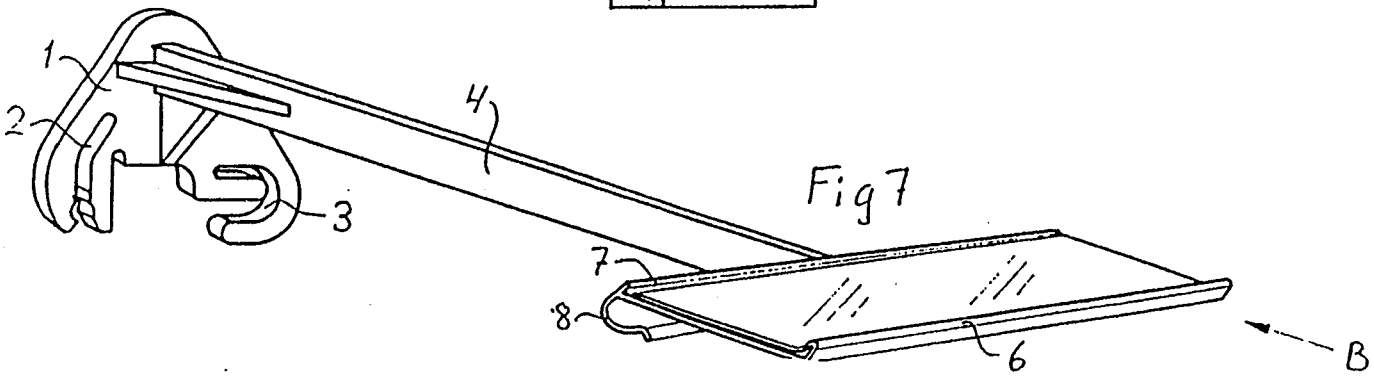
FIG. 7 is a view from above showing the pocket in a raised position.

Thus, when using the illustrated device, the mounting part 1 is fitted onto the inwardly lying parts of two prongs projecting from a rack, said prongs being received in the slots 2 and 3. The pocket 5 intended to receive information-carrying labels relating to the articles displayed on the prongs is therewith located forwardly of the prong ends, so as to enable the labels to be easily read and clearly disclosing to which goods the label refers. When a packaged article, which may be threaded onto the prongs, is removed from the prongs, the pocket 5 will swing upwards from the position shown in full lines in FIG. 6 to the position shown in broken lines, thereby enabling the packaged article to be removed without being obstructed by the pocket. See also FIG. 7. Upon removal of the packaged article, the pocket will automatically swing down under the force of gravity.

This upward swinging of the pocket 5 is made possible by means of the aforementioned slot 9 provided in the holder part 8 and receiving the cantilever arm 4. The extent to which the pocket is able to swing upwards can be limited by commensurate limitation of the depth of the slot 9. This upward movement of the pocket is suitably limited to an angle of about 90°.

Another important advantage provided by the slot 9 is that it functions automatically to centre the pocket 5 and hold said pocket in its correct position on the pivot-pin 4, the pocket being prevented from moving sideways as a result of the coaction between the slot 9 and the arm 4.

Thus, the illustrated hinge mechanism, which is extremely simple and cheap to manufacture, also provides a very simple stop means which prevents over-rotation of the pocket as the pocket is raised, and also a simple and effective means for locking the pocket against sideways movement.

The support part 11 of the arm 4 which supports against the rear wall of the pocket 5 also enables the pocket to be readily opened in order to change respective information-carrying labels. Thus, the store personnel need only press on the front wall of the pocket 5, in the direction of the arrow A in FIG. 6, this pressure causing the upper edge of the pocket to open due to the coaction with the rearwardly-lying supporting part 11, as will readily be understood.

Figure 9:
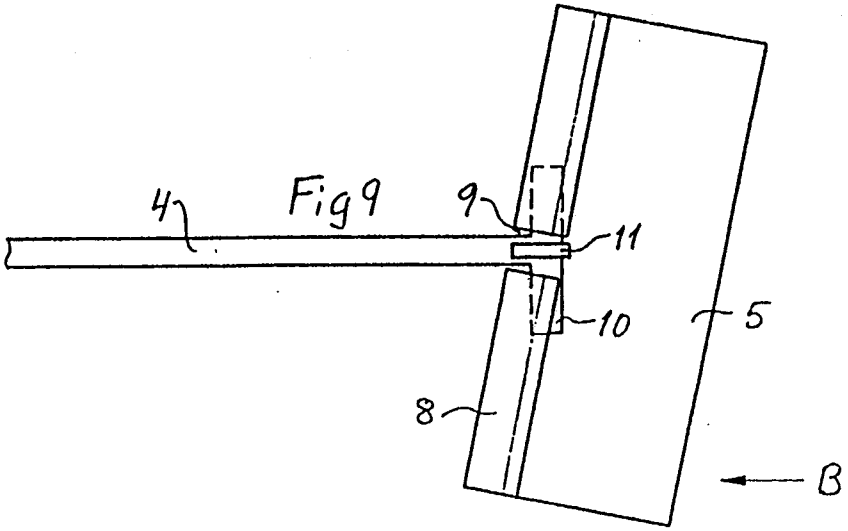
FIGS. 8 and 9 are views of the holder from below and show the holder pocket in a normal position and in a latched position respectively.
Figure 8:
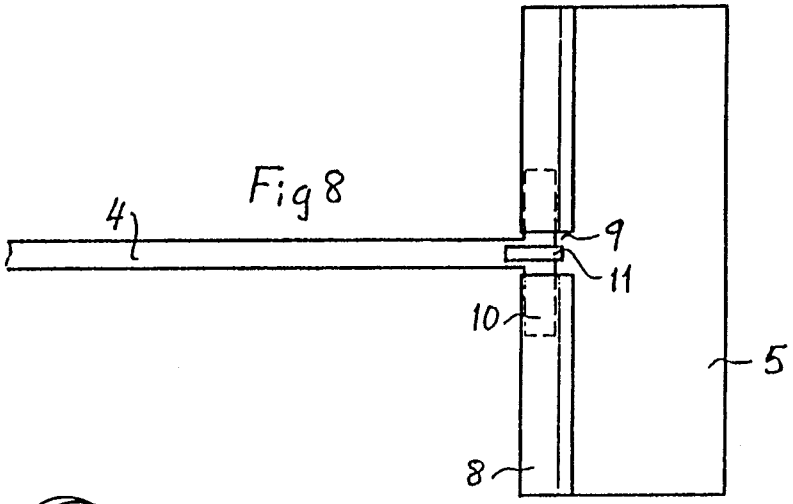

Further, the pocket 5 can easily be held in an upwardly swung position, which is highly beneficial to the store personnel concerned, for instance when hanging further packaged articles or goods on the prongs of the rack. All that is necessary in this regard is to press the pocket in the direction of the arrow B in FIG. 7 in the upwardly swung position of said pocket. As will be seen when comparing FIG. 8 with FIG. 9, the pivot-pin 10 is therewith partially pressed out from the channel formed by the part 8, therewith preventing the pocket from swinging down to a vertical position until the pivot-pin has again been pressed into the channel.

A holder of the aforedescribed kind can be produced very easily, since the pocket 5 and the pivot-pin receiving channel 8 may consist of one part of a long, extruded profiled strip produced from a flexible plastic material, whereas the cantilever arm 4, the mounting part 1 and the fixed pivot-pin 10 may be produced as a one-piece structure, by pressure-moulding a rigid plastic material. The inventive holder can be easily assembled by the purchaser, therewith reducing both the requisite transporting space and storage space.

Although the inventive holder has been described with reference to a preferred exemplifying embodiment thereof, it will be understood that modifications and changes can be made within the scope of the following claims. For instance, the channel which extends along the rear pocket wall may be replaced with one or more shorter, channel-shaped parts which coact with a pivot pin 10 of desired length. Furthermore, the forward end of the arm 4 may be provided with more than one pocket supporting part 11, if so desired.

I claim:

1. A holder for a strip-like information carrier intended for use in shops, stores and like establishments in conjunction with goods and articles that are displayed on pronged racks, said holder comprising a mounting part (1) which is intended to be fitted to a pronged part of a stand, and a part (5) which is connected to the mounting part and which is intended to receive said information carrier, wherein the mounting part is intended to be secured to an inwardly-lying part of at least one prong and includes a substantially rigid cantilever arm (4) which extends above and essentially parallel with said prong; the information-carrier receiving part of the holder has the form of a pocket which is open along an upper edge thereof; the pocket is so mounted on a forward end of the cantilever arm as to enable the pocket to repeatedly swing upwardly as each article is removed from the prong, and thereafter downwardly; and the forward end of the arm has at least one supporting part (11) which bears against a rear wall of the pocket so that when said pocket is in a downwardly swung position, the pocket can be opened by pressing against a lower part of a front wall of the pocket.

2. A holder according to claim 1, wherein the upward swinging movement of the pocket is limited, so that it is always able to return to a normal, downwardly swung position under the influence of gravity.

3. A holder according to claim 1, wherein the pocket is transparent; at least one part (8) of an upper part of the rear pocket wall is folded rearwardly to form a downwardly open, cylindrical channel; and the forward end of the cantilever arm has a transversely extending pivot-pin (10) which coacts with the channel.

4. A holder according to claim 3, wherein a cross-dimension of the channel opening is somewhat smaller than a cross-dimension of the pivot-pin; and the pin can be pressed into the channel while flexing the channel wall slightly outwards, so that the pivot pin will be held securely in the channel as the wall returns to an original position.

5. A holder according to claim 3, wherein the channel wall (8) is provided with a slot (9) which receives the cantilever arm when the information-carrier receiving part (5) is swung up; and the depth of the slot is adapted to limit upward swinging of the pocket such as to allow said pocket to return to a downwardly-depending position under the influence of gravity.

6. A holder according to claim 5, wherein the depth of the slot (9) is chosen so that the pocket can be swung up through an angle of about 90°.

7. A holder according to claim 3, wherein the mounting part, the cantilever arm and the pivot-pin fixedly joined to the arm form a one-piece structure produced by pressure-moulding a rigid plastic material.

8. A holder according to claim 1, wherein the pocket (5) is an integral part of an extruded profiled section of flexible plastic material.

* * * * *

UNITED STATES PATENT AND TRADEMARK OFFICE

CERTIFICATE OF CORRECTION

PATENT NO. : 5,442,872

DATED : August 22, 1995

INVENTOR(S) : Richard Moser

It is certified that error appears in the above-identified patent and that said Letters Patent is hereby corrected as shown below:

Title page, item [30]
The filing date of International Application No. PCT/SE92/00776 should read: -- November 11, 1992 --.

Signed and Sealed this

Second Day of January, 1996

Bruce Lehman

*Attest:*

BRUCE LEHMAN

*Attesting Officer*

*Commissioner of Patents and Trademarks*